United States Patent [19]

Kaufman et al.

[11] Patent Number: 5,057,032

[45] Date of Patent: Oct. 15, 1991

[54] BOARD EDGE CONNECTOR

[75] Inventors: John W. Kaufman, Hershey; Donald J. Summers, Shiremanstown, both of Pa.

[73] Assignee: AMP Incorporated, Harrisburg, Pa.

[21] Appl. No.: 532,411

[22] Filed: Jun. 4, 1990

[51] Int. Cl.[5] ..... H01R 13/62

[52] U.S. Cl. ..... 439/326; 439/62

[58] Field of Search ..... 439/326, 327, 328, 630, 439/636, 637, 62, 329

[56] References Cited

U.S. PATENT DOCUMENTS

| | | | |
|---|---|---|---|
| 3,188,601 | 6/1965 | Tar | 439/328 |
| 3,720,907 | 3/1973 | Asick | 439/636 |
| 3,795,888 | 3/1974 | Nardo et al. | 339/176 MP |
| 3,848,952 | 11/1974 | Tighe, Jr. | 339/91 R |
| 3,920,303 | 11/1975 | Pittman et al. | 339/91 R |
| 4,084,874 | 4/1978 | Georgopulos | 339/75 MP |
| 4,128,289 | 12/1978 | Occhipinti | 339/75 MP |
| 4,136,917 | 1/1979 | Then et al. | 339/17 L |
| 4,185,882 | 1/1980 | Johnson | 439/326 |
| 4,575,172 | 3/1986 | Walse et al. | 339/75 MP |
| 4,601,530 | 7/1986 | Coldren et al. | 339/103 M |
| 4,678,252 | 7/1987 | Moore | 439/62 |
| 4,718,859 | 1/1988 | Gardner | 439/329 |
| 4,737,120 | 4/1988 | Grabbe et al. | 439/326 |
| 4,747,790 | 5/1988 | Masuda et al. | 439/326 |
| 4,778,403 | 10/1988 | Ikesugi et al. | 439/329 |
| 4,781,612 | 11/1988 | Thrush | 439/328 |
| 4,810,203 | 3/1989 | Komatsu | 439/326 |
| 4,826,446 | 5/1989 | Tuntwait | 439/326 |
| 4,832,617 | 5/1989 | Brown | 439/326 |
| 4,850,891 | 7/1989 | Walkup et al. | 439/327 |
| 4,850,892 | 7/1989 | Clayton et al. | 439/326 |
| 4,911,653 | 3/1990 | Walton et al. | 439/326 |

*Primary Examiner*—Gary F. Paumen
*Assistant Examiner*—Hien D. Vu
*Attorney, Agent, or Firm*—Katherine A. Nelson

[57] ABSTRACT

A board edge connector 10 rotatable between a first and electrically disengaged angular position to a second angular position wherein electrical terminal members 70 of the connector 10 are electrically engaged to conductive areas 102 on a circuit board 92 includes housing means 12 and a plurality of electrical terminal members 70 disposed in terminal receiving cavities 50 therein. Housing means 12 includes a board receiving slot 34 extending along a front wall thereof and in communication with the terminal receiving cavities 50. Slot 34 has opposed upper and lower bearing surfaces 26,21 defining opposed parallel planes and further defining means for guiding connector 10 onto the board 92 at a preselected angle until the leading edge 98 of the board 92 engages a first stop surface 60 defining a first angular position. Fulcrum means 80 have arcuate bearing surfaces engageable with the second board surface 92 at at least two spaced locations along slot 34 defining an axis of rotation and allow connector 10 to be rotatably moved about the board edge from the first position to the second position.

7 Claims, 7 Drawing Sheets

BOARD EDGE CONNECTOR

FIELD OF THE INVENTION

The present invention relates to an electrical connector for engaging a portion of an edge of a circuit board and the like and for making electrical connection to conductive areas thereon and more particularly to a board edge connector having essentially zero insertion force.

BACKGROUND OF THE INVENTION

In making electrical interconnections along the edge of a circuit board it is important to make good electrical contact with conductive areas on boards that max vary in thickness over a range of tolerances. Further, it is generally desirable to have a connector that has essentially zero insertion force to minimize wear of both the contacts and the conductive areas on the board. These factors are even more critical when one considers the necessity for providing a plurality of contacts on close centerline spacing. Furthermore, the close centerline spacing of the contacts require that the terminal members be relatively thin and thus they are more susceptible to damage than terminal members that are thicker. It is desirable, therefore, to provide means for protecting the terminal members and particularly the contact surface of the terminal members from interfacing the board while the connector and board are moved into position for electrical interconnection.

In today's electronic equipment a circuit board may be mounted in a piece of equipment and numerous cables may be required to attach along an edge of such a board. Connectors are terminated to these electrical cables having a plurality of conductors arranged as discrete wires or ribbon cable or the like. Preferably the connector is one which essentially requires zero insertion force and can be rotatably moved from a first to a second position to engage the conductive pads along the edge of the board. It is further desirable to have a connector that has a minimum number of parts and does not require a separate camming mechanism.

U.S. Pat. No. 3,848,952 discloses a zero insertion force card edge connector having a plurality of connector spring contacts mounted in the housing, the spring contacts providing for adjustment in both the X and Y direction.

Furthermore, it is also desirable to have a board edge electrical connector that is suitable for use with boards made of various materials such as plastic, ceramic coated dielectric or dielectric coated steel.

SUMMARY OF THE INVENTION

Accordingly, the present invention is directed to an electrical connector adapted to engage a portion of an edge of a circuit board that eliminates or alleviates the problems and deficiencies associated with the prior art. The connector comprises a housing means having a plurality of terminal receiving cavities extending between opposed rearward and forward surfaces thereof, a board receiving access slot extending along the forward surface and through the opposed sides of the housing means and in communication with each of the plurality of terminal cavities. A plurality of terminal members are disposed in the terminal receiving cavities such that a first connecting portion extends a selected distance into the board receiving slot. The slot is defined by opposed upper and lower bearing surface portions of the housing defining a board receiving entrance formed by opposed parallel angled planes spaced by a selected dimension. Guide means are aligned with the slot such that the connector can be engaged with the board at a preselected angle until the leading edge of the board reaches a first stop surface. A fulcrum means at the forward entrance of the access slot provides a bearing surface and defines an axis of rotation parallel to the slot, thereby allowing the connector to be rotatably moved about the board edge from a first position to a final position. The connector is moved onto the leading edge of the board by receiving the edge of the board into the slot at a preselected angle until the leading edge of the board abuts a stop surface within the terminal cavity. The connector is then moved or cammed from a first position to second position thereby bringing the board conductive surfaces into electrical engagement with the terminal contact surfaces. Concomitantly the board moves inwardly by an incremental distance and wiping action occurs between the terminal contacts and the conductive pads on the surface of the board.

Each terminal member further includes a second connecting portion which in the preferred embodiment is terminated by an insulation displacement connection (IDC) to a wire of a ribbon cable or discrete wire of a cable.

It is an object of the present invention to provide a connector having a one piece dielectric housing, which guides a plurality of terminal members disposed therein, onto a circuit board while protecting the contact mating surface of the terminal members from interfacing with the board prior to reaching the position for mating.

It is also an object of the invention to provide a board edge connector suitable for use with non-chamfered boards.

It is another object of the invention to provide a terminal member, which supports the circuit board on both the top and the bottom in the mated condition, thereby minimizing bowing of the board due to spring compression forces.

It is an additional object of the invention to provide means for prevention of overstress or damage to spring terminal members during insertion of the board.

Some of the objects and advantages of the invention having been stated, others will appear as the description proceeds when taken in connection with the accompanying drawing.

DETAILED DESCRIPTION OF THE PREFERRED EMBODIMENT

Figure 1:
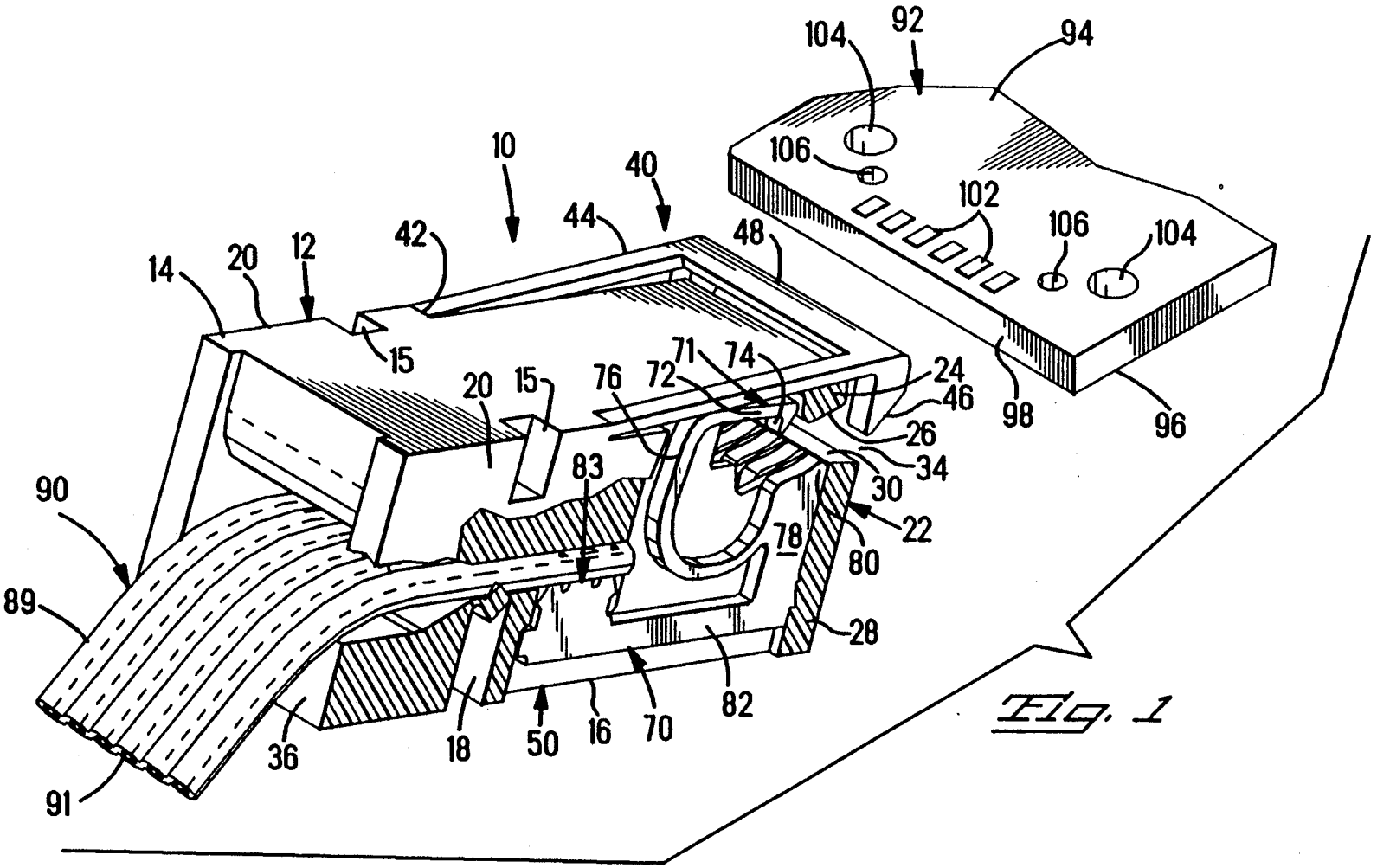
FIG. 1 is a perspective view of the connector of the present invention terminated to an electrical cable and exploded from circuit board, with part of the connector being sectioned.
Figure 2:
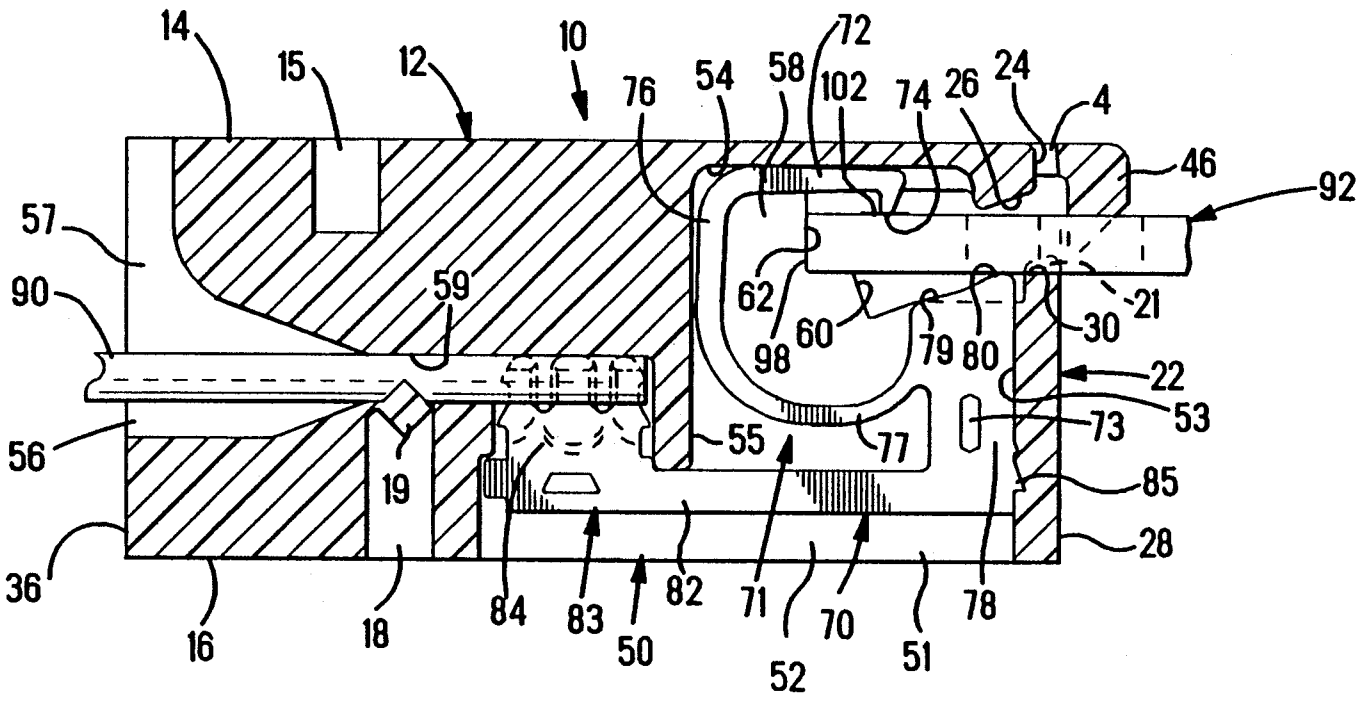
FIG. 2 is a cross section of the connector of the present invention having a circuit board in its mated position.
Figure 3:
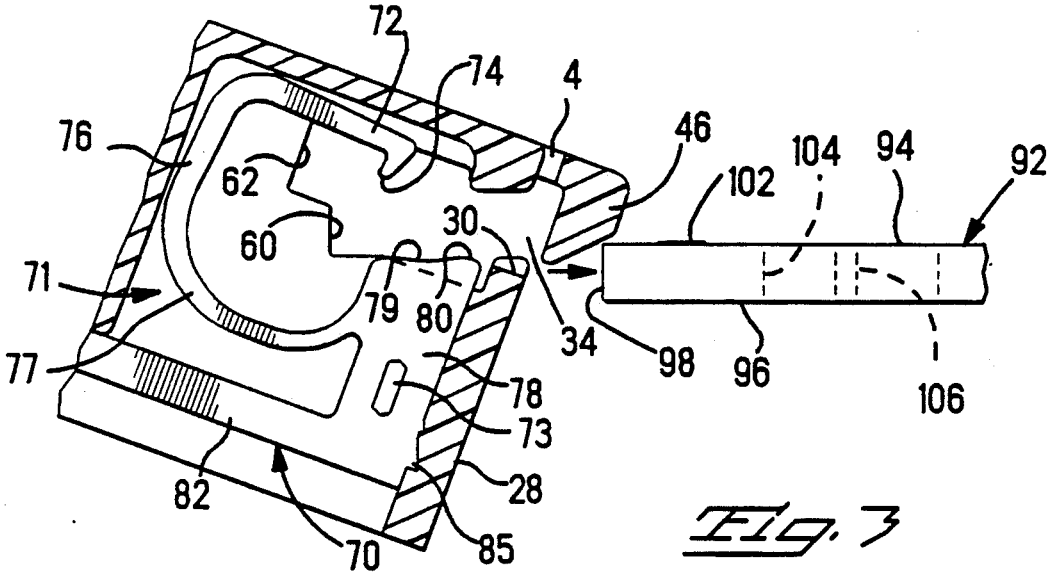
FIGS. 3 through 7 are cross sectional views of the board receiving contact portion of the connector of FIG. 1 illustrating the sequence that occurs during the mating of the connector to the board.

Referring now to FIGS. 1 and 2, connector 10 is comprised of a housing means 12 and a plurality of terminal members 70. For purposes of illustration only the latch means 40 is shown in its raised position in FIG. 1. Housing means 12 has a top wall 14, bottom wall 16, opposed side walls 20, and opposed front and rear walls 22,36 respectively. Front wall 22 includes an upper portion 24 and lower portion 28. Housing means 12 further includes a plurality of terminal receiving cavities 50 having forward and rearward portions 52,56 extending from the front wall 22 to the rear wall face 36, the cavities 50 being separated by internal walls 58. A board receiving slot 34 defined by lower and upper surfaces 26,30 of upper and lower front wall portions 24,28, extends along front wall 22 and through opposed sides 20 of the housing means 12 and provides access into the plurality of terminal receiving cavities 50 for the board as the connector is moved thereonto. Internal walls 58 of housing means 12 are configured within terminal receiving cavities 50 to provide first and second board stop surfaces 60,62.

Forward portion 52 of each of the terminal receiving cavities 50 includes forward wall 53, upper wall 54, and rear wall 55. Forward cavity portion 52 also extends through slot 51 in the bottom wall 16 for receiving the terminal members 70 therein. Rearward portion 56 includes conductor receiving portion 57 and conductor terminating section 59.

Terminal members 70 include first and second connecting portions 71,83 respectively. The first connecting portions extend a selected distance into the board receiving slot and are adapted to engage conductive areas on the board. Each first connecting portion 71 is generally a C-shaped portion having beam portion 72 including contact area 74 extending proximate to top wall 54, rear arm 76 extending proximate rear wall 55, lower arm 77 and an upstanding leg portion 78, which lies adjacent lower front wall portion 53.

Second connecting portions 83 of terminal members 70 include an IDC portion 84 extending from arm 82 that extends rearwardly from the respective front leg portions 78. A plurality of embossments 73 are disposed on the body of terminal members 70 to help secure them within the respective cavities 50 of the housing means 12. Terminal members 70 further include a plurality of lances 85 for engaging portions of the cavity adjacent walls to secure the terminal members 70 within the housing. As shown in FIGS. 1 and 2 conductor wire 90 is terminated to terminal member 70 through the IDC connection 84. Details of such an IDC connection are disclosed in U.S. Pat. No. 4,601,503. In the embodiment shown this, IDC portion has three parallel legs which pierce through the insulation 89 to electrically engage the wire 91 encased within the insulation.

Housing means 12 further includes a latch means 40 hinged at 42 to the upper surface having parallel deflectable arms 44 extending from 42 toward the front face 22, arms 44 having latch portions 46 protruding downwardly therefrom and integrally formed and joined by center bar 48. The latch means 40 cooperates with latch receiving apertures 104 of the circuit board 92 as more fully described below.

As shown in FIG. 1 connector 10 is designed to be mounted to a circuit board 92 having a leading edge 98 with a plurality of conductive areas or pads 102 disposed on a first major surface 94 thereof. Circuit board 92 further includes a plurality of first and second apertures 104 and 106 extending through the board from a first to a second major surface 94,96 thereof. Apertures 104 are adapted to engage the latch portions 46 of latch means 40 when the connector 10 is fully mated to the board and a plurality of second apertures 106 for engaging protrusions 21 on side wall 20 of the housing means 12 upon fully mating the connector 10 to board 92.

The sequence of mating connector 10 to circuit board 92 is shown in FIGS. 3 through 7. For purposes of illustrating and understanding the invention the connector is shown in a fixed position and the board is shown at an angle. It is to be understood that the principle of relative motion between the connector 10 and board 92 is the same whether it is the connector 10 or the board 92 that is rotated and moved during the process of mating.

Figure 4:
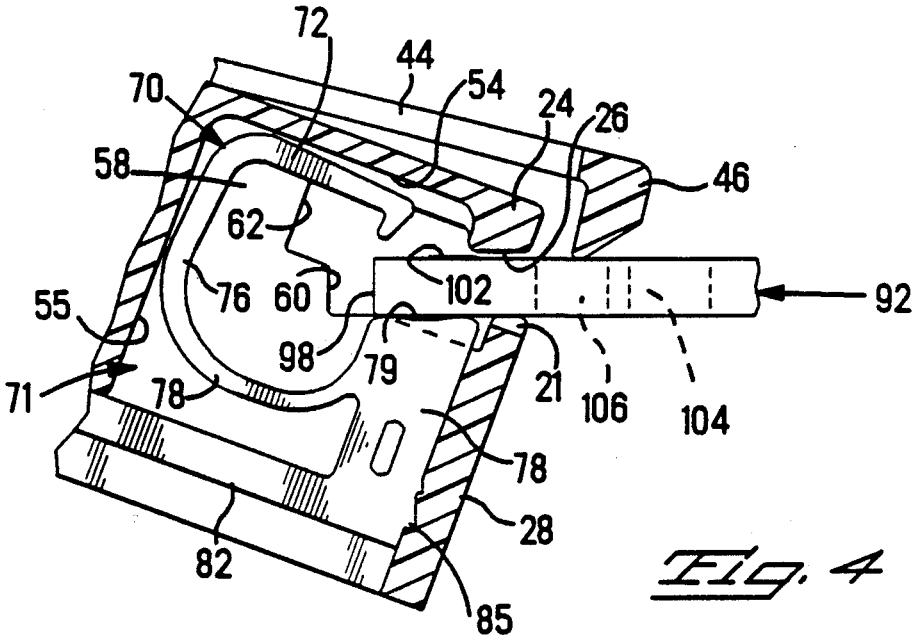
Figure 5:
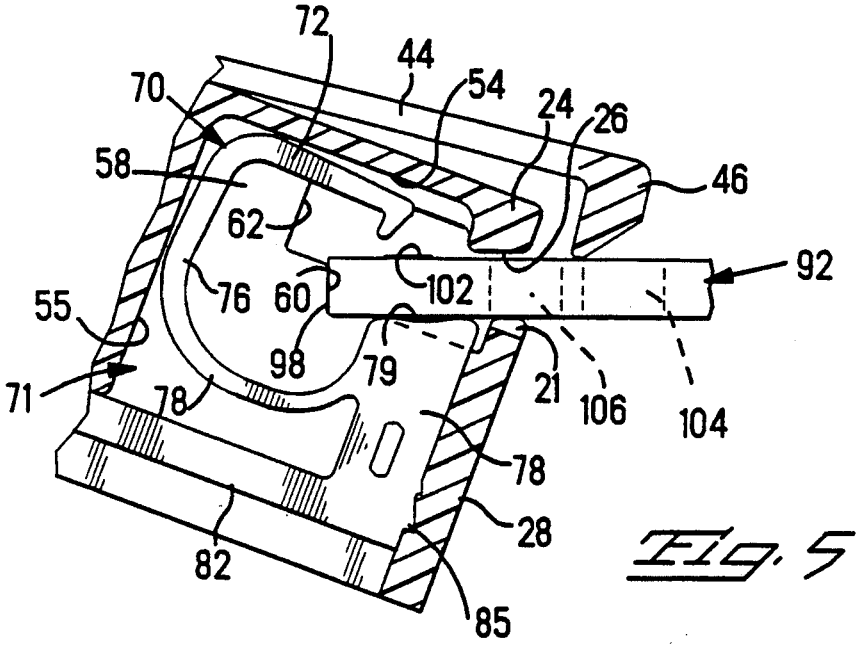
Figure 6:
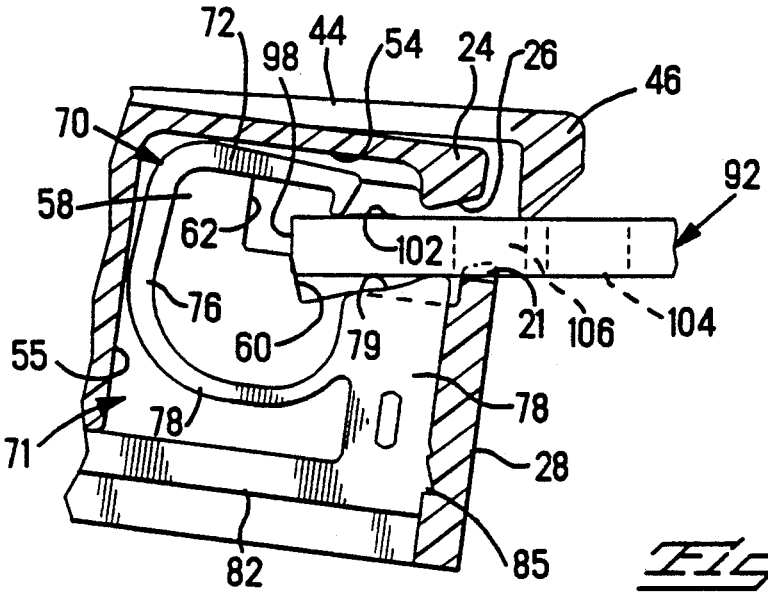
Figure 7:
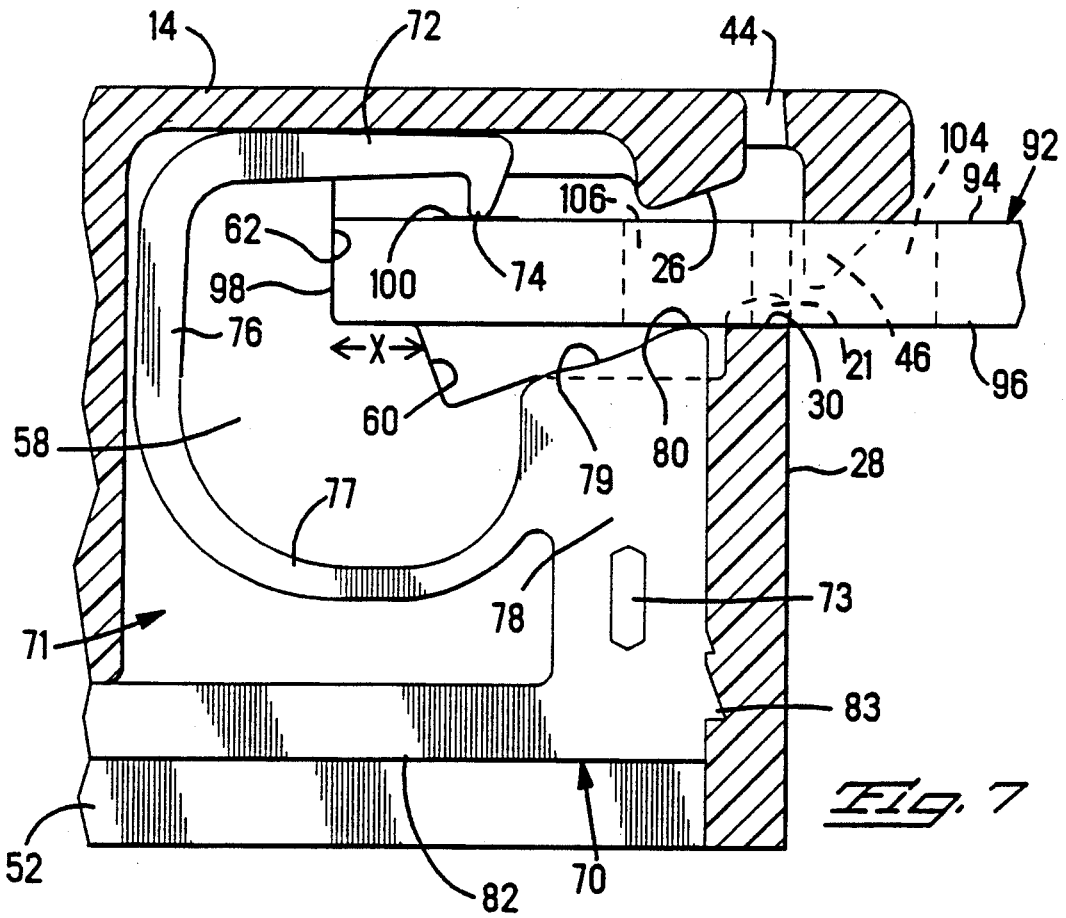
Figure 8:
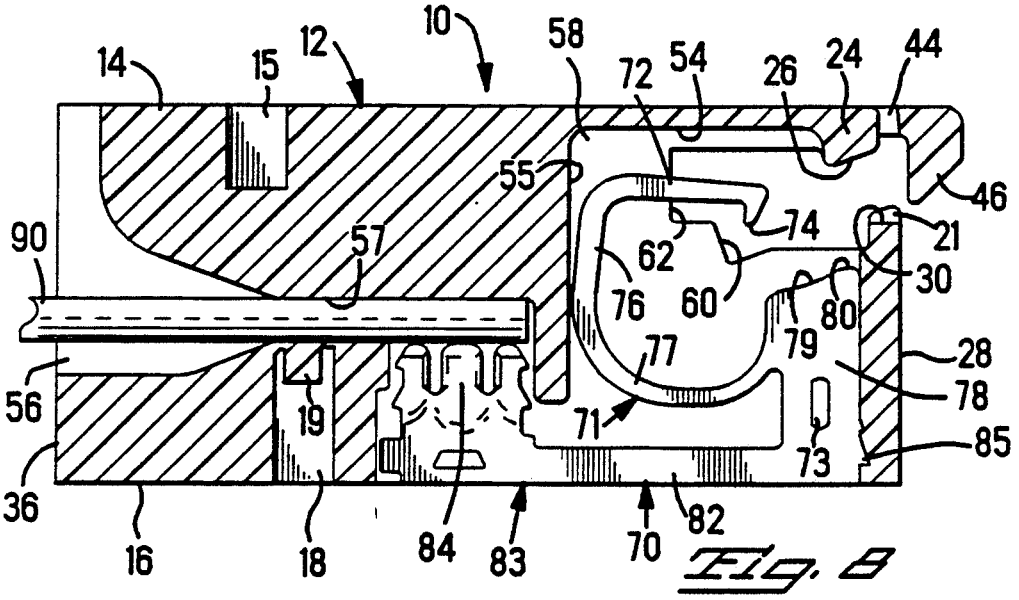
FIG. 8 is a cross section of a preloaded connector prior to being terminated to a cable or being engaged to a circuit board.

As shown in FIGS. 3-7, board 92 is received into access opening 34 at an angle, the angle being predetermined such that the lower angled surface 26 on wall portion 24, angled protrusions 21 on front wall 28, and upper surface 79 of terminal member 70 are angled at a preselected amount to provide an access route for circuit board 92 as it is received into board receiving slot 34 and terminal cavities 50. As the board is received into the slot 34, the ends 46 of latch arms 44 touch the major surface 94 of board 92 and the latch arms 44 are deflected upwardly out of the way so that the latch arms 44 ride along the upper surface 94 of the board 92 as connector is moved onto board 92 and the board 92 is received into the slot 34 as seen in FIGS. 4-6. As the connector 10 is pivoted into final position, ends 46 of latch arms 44 enter the corresponding apertures 104 on circuit board 92 and the node or protrusion 21 on front wall 28 enter apertures 106 from the second major surface 96 of circuit board 92. FIG. 7 shows a cross sectional view of the connector 10 mated to board .92. Board 92 is received into slot 34 of connector 10 as shown in FIGS. 4 and 5 until the leading edge 98 of board 92 abuts the first stop surface 60 defining a first angular position. At that point as shown in FIG. 5, the connector is rotated to a second angular position about the board with the fulcrum points 80 on surface 79 of terminal members 70 thereby bringing the contact surface 74 of the terminal member 70 into engagement with the corresponding contact pad 102. The upper contact arm 72 is forced upward to abut the upper wall 54 of the forward terminal cavity portion 52 as the board 92 connector 10 is pushed straight into its second angular or mated position whereby leading board edge 98 lies against second stop surface 62 as shown in FIG. 7. By moving the relative position of the connector and the board this incremental distance, a wiping action is provided by the contact surface 79 of the terminal member 70 against the contact pad 102 thereby assuring good electrical contact between the terminal and the pad.

In making the electrical connector 10, the housing means 12 is molded from a suitable engineering plastics such as a polycarbonate or the like. Preferably the material selected has sufficient spring characteristics to allow integral molding of the flexible latch member. Terminal members 70 are stamped from a suitable contact material such as phosphor bronze or the like and in the preferred embodiments are about 0.016 inches thick. Terminal members 70 are preloaded into the housing means 12 such that the terminal members 70 are inserted into respective terminal cavities 50 with the IDC termination section 84 above the wire receiving portion 57. Upon inserting discrete wires or cable 90 and upon termination thereto the insulation displacement portion 84 of the terminal members 70 engage the wire 91 of the cable 90 and the terminal members 70 are moved into the corresponding terminal receiving cavities 50 with first connecting portions 71 in position ready to be mated to board 92 as previously described. To provide strain relief for conductors 90 of a cable, a housing portion 19 located at the base of aperture 18 of the lower housing wall 16 is punched into the wire.

Figure 9:
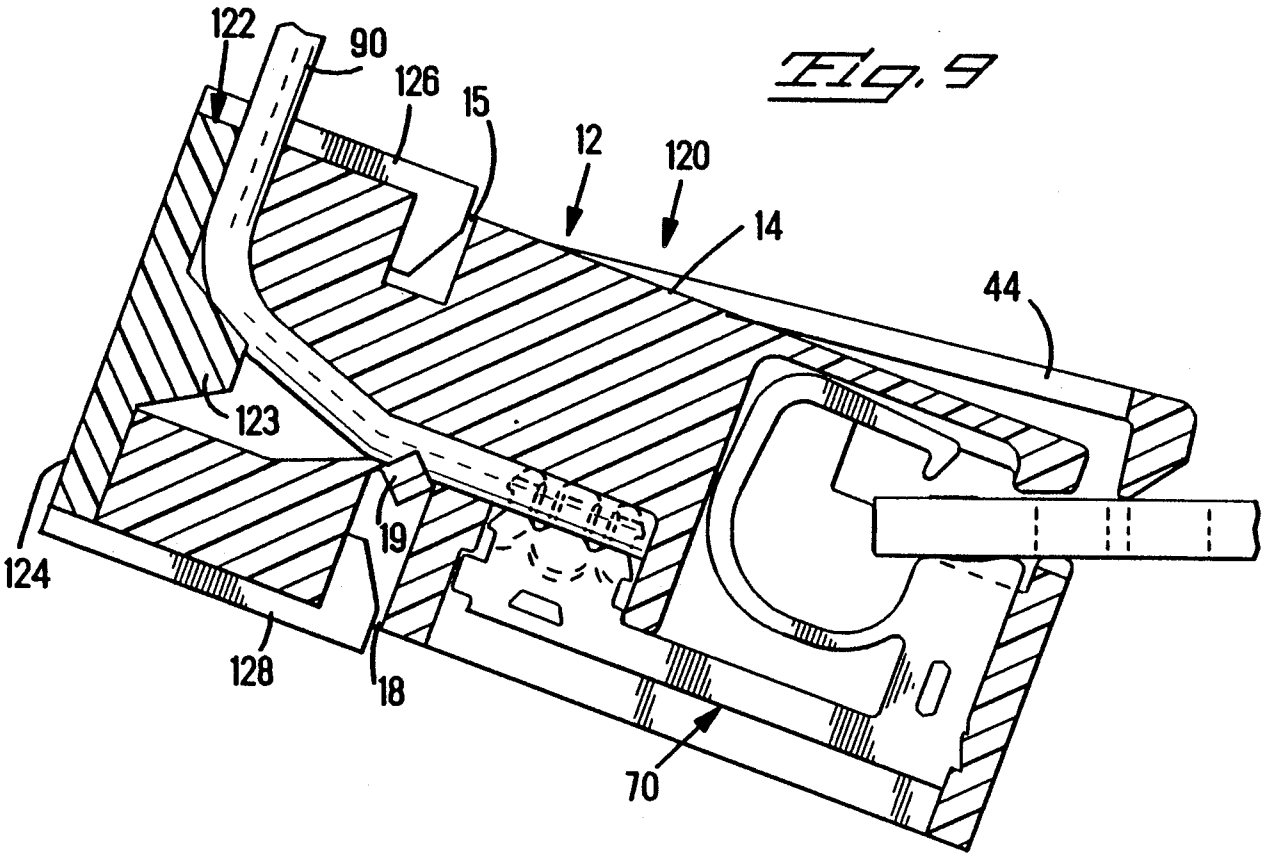
FIG. 9 is a cross sectional view of an alternative embodiment of the connector made in accordance with the invention.

FIG. 9 shows an alternative embodiment 120 wherein the conductors 90 exit connector 120 at right angles to the board. In this embodiment housing means 12 and terminal members 70 are the same as connector 10, an additional rear cover 122 is provided including back portion 124 and cantilever latch arms 126,128, which engage respective apertures 18 and 15 in housing means 12 to latch the rear cover member 122 in place. As shown in FIG. 9 rear cover member 122 has extended internal portion 123, which aids in pushing conductors 90 into the right angle position.

Figure 10:
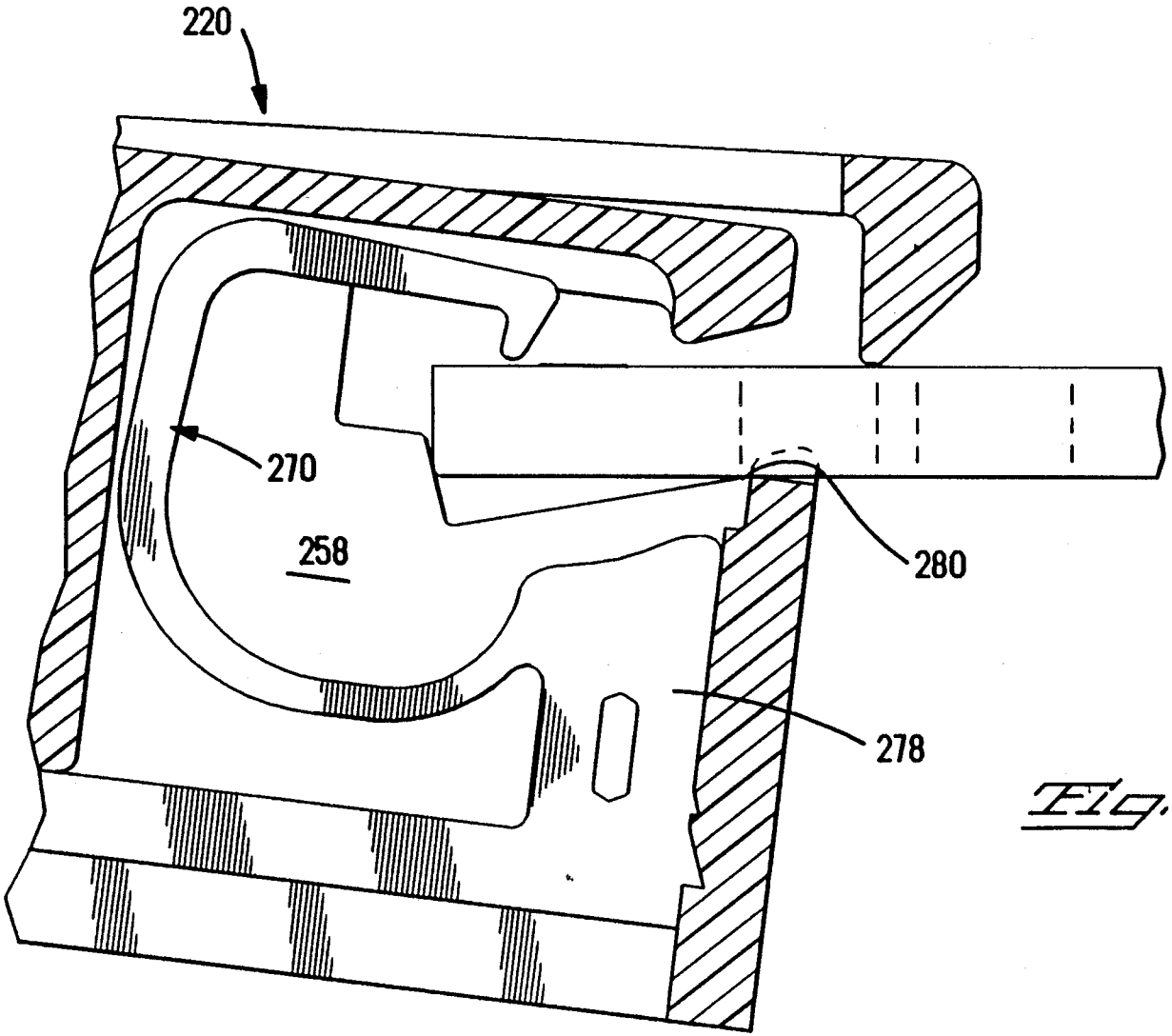
FIG. 10 is a further alternative embodiment of the invention.

FIG. 10 shows a further alternative embodiment 220 wherein the fulcrum point 280 is provided by on the internal walls 258, rather than on the upper surface of terminal arm 278 of terminal member 270.

The connector of the present invention provides an essentially zero insertion force connector for engaging an array of electrical conductive areas along a portion of an edge of a circuit board. The connector provides protection for the contact surface of the terminal thereby permitting the use of non-chamfered circuit boards as well as circuit boards made of material such as dielectric coated steel, ceramic and the like, which can damage unprotected contact areas.

The present invention also provides a means whereby a plurality of thicknesses of circuit boards typically from 0.054 through 0.070 can be interconnected with the same connector. The latch arms of the connector housing and the normal force produced by the terminal members are sufficient to hold the connector in position within the tolerance range of the circuit boards.

It is thought that the electrical connector of the present invention and many of the attendant advantages will be understood from the foregoing description. It will be apparent that various changes may be made in the form, construction and arrangement of parts thereof without departing from the spirit or scope of the invention or sacrificing all its material advantages.

We claim:

1. An electrical connector adapted to engage a portion of an edge of a circuit board having first and second major surfaces and having conductive areas on said first major surface proximate the edge thereof, said connector being rotatable between a first and electrically disengaged angular position to a second angular position wherein the electrical terminal members of said connector are electrically engaged to said conductive areas on said circuit board, said connector comprising:

housing means having a plurality of terminal receiving cavities extending between opposed front and rear walls thereof, a board receiving slot extending along said front wall and through opposed sides of said housing means in communication with each of said plurality of terminal receiving cavities;

a plurality of electrical terminal members disposed in said terminal receiving cavities rearwardly of said front housing wall, said terminal members including first and second connecting portions, said first connecting portions extending a selected distance into said board receiving slot and including a contact area adapted to engage said conductive areas on said board upon said connector being moved to its second angular position;

opposed upper and lower bearing surface portions of said housing means within said slot defining opposed parallel planes associated with said first and second major surfaces of said board, said slot being of a selected dimension corresponding closely to the thickness of the board and defining means for guiding said connector onto said board at a preselected angle until the leading edge of said board engages a first stop surface within said terminal receiving cavity thereby defining a first angular position, said first connecting portions being disposed inward of said upper bearing surface portions and said contact area recessed above said plane of said upper bearing surface portions;

fulcrum means at said front wall of said slot, said fulcrum having arcuate bearing surfaces engagable with said second major board surface at least at two spaced locations along said slot and defining an axis of rotation parallel to said slot and allowing said connector to be rotatably moved about the board edge from a first position through said intermediate position to a final position; and means of said housing means engaging said second major surface of said board at least at two spaced locations proximate said front wall for preventing rotation until said connector is in said first angular position, whereafter said anti-rotation means is opposed from corresponding recess means of said second board surface and is received thereinto upon rotation of said connector from said first angular position through said intermediate position to said second angular position, said housing means including rotation stop means defining said second angular position, whereby said upper and lower planes of bearing surfaces of said slot for said board protect at least contact areas of said first connecting portions of said terminal members of said connector from damage during initial receipt of said board into said slot and said connector can be mounted to a circuit board and electrical interconnection between said terminal members and said conductive areas can be effected with minimal insertion force.

2. The electrical connector of claim 1 wherein said first connecting portions of said terminal members each include a deflectable beam section, said beam section being deflectable by said board as said connector is moved from said first angular position to said second angular position, said respective beam sections providing sufficient normal force when deflected to maintain electrical interconnection between said terminal members of said connector and corresponding conductive areas on said board.

3. The electrical connector of claim 1 wherein said second connecting portion is an insulation displacement member adapted to be terminated to an insulated wire member.

4. The electrical connector of claim 1 wherein said second connecting portion of said terminal members are terminated to respective conductors of a ribbon cable assembly.

5. The electrical connector of claim 1 wherein said second connecting portion of said terminal members are terminated to respective conductors of a discrete wire cable assembly.

6. The electrical connector of claim 1 further including latching means cooperable with apertures of said board, said latching means including free ends deflectable by said board during insertion and relative rotation of said connector and board, said latching means securing said connector to said board when said connector is in said second angular position.

7. The electrical connector of claim 6 wherein said latching means is integrally molded to said housing means.

* * * * *